United States Patent [19]

Assanah et al.

[11] 4,455,696

[45] Jun. 26, 1984

[54] PORTABLE GRAVITY BATH

[76] Inventors: Albert A. Assanah, 3407 Wild Cherry Rd., Baltimore, Md. 21207; Fitzroy Assanah; George G. Assanah, both of 3526 Overview Rd., Baltimore, Md. 21215

[21] Appl. No.: 329,447

[22] Filed: Dec. 10, 1981

[51] Int. Cl.[3] ..... A47K 3/02

[52] U.S. Cl. ..... 4/584; 4/538; 4/516

[58] Field of Search ..... 4/516, 515, 518, 538, 4/546, 549, 548, 553, 554, 584

[56] References Cited

U.S. PATENT DOCUMENTS

| | | | |
|---|---|---|---|
| 2,682,058 | 6/1954 | Wolfe | 4/516 |
| 2,760,207 | 8/1956 | Glintz | 4/516 |
| 2,850,742 | 9/1958 | Glintz | 4/516 |
| 3,192,537 | 7/1965 | Coffman et al. | 4/516 |
| 3,694,826 | 10/1972 | Pugh | 4/516 |
| 4,081,867 | 4/1978 | Simeola | 4/516 |

*Primary Examiner*—Henry K. Artis

*Attorney, Agent, or Firm*—Walter G. Finch

[57] ABSTRACT

The invention is an improved bath device for patients, particularly bedridden, wheelchair dependent, and incontinent patients. The bath device is portable and provides a flow or liquid by gravity. The bath device is designed to operate independently or co-jointly which another form of incontinent equipment. The portable bath device is compact and easily carried or transported on a mobile facility. The bath device is constructed of flexible water-proof material that also has insulating qualities. The bath device has an inlet or fill port, a vent, and an outlet, each of which is sealable. The bath device has a facility for hanging the bath device on portable supports in a manner that facilitates complete use of all the contained liquid.

8 Claims, 4 Drawing Figures

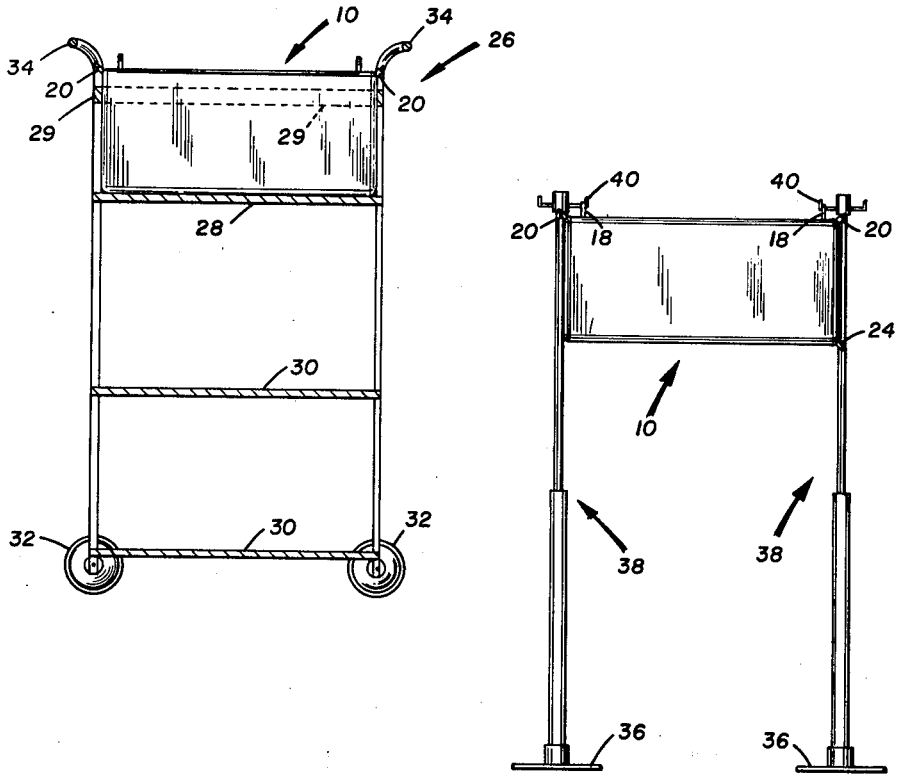

PORTABLE GRAVITY BATH

BACKGROUND AND SUMMARY OF THE INVENTION

The invention relates to patient care equipment and in particular to equipment for the care of incontinent patients. Specifically, it relates to a bath facility that is portable and in which the water flows by gravity, and which is particularly useful for incontinent patients who also are difficult to move because they lack the use of their limbs. The portable gravity bath facilitates care by a single attendant.

The portable gravity bath may be used for patients in an ordinary bed or in a hospital type bed. The portable gravity bath is particularly useful in conjunction with a patient transport and care vehicle disclosed in a copending application, Ser. No. 334,233 filed Dec. 24, 1981.

Incontinence care and the problems associated with the management of incontinence among wheelchair dependent and bedridden patients at home, in hospitals, and in nursing homes have imposed a tremendous burden upon society, namely the providers and recipients of care and their families. This has occurred primarily because of a lack of adequate and appropriate means to deliver care, and from an ever increasing number of the nation's elderly, age 65 years and older, with dementia secondary to Primary Degenerative Dementia.

Since the nineteen sixties, research on the problem of incontinence expanded the use of surgical procedures, indwelling and external cathethers, and for a time bowel and bladder training programs in the treatment and management of urinary and fecal incontinence with varying degrees of success. Development of pneumonics and formation of decubiti necessitating a long hospital stay, due to urinary incontinence have been successfully reduced and curtailed to some extent. Success with fecal incontinence, however, with its devastating impact upon patients, relatives, and providers of care, has been slower and more difficult to achieve, because of ongoing research in this area and inability of providers to meet the demand for care by larger and larger numbers of patients with greater dependencies, more severe physical disabilities, and intellectual impairment due to cerebral infarcts.

The high incidence of multi-infarct dementia in individuals over 65 in our society, coupled with an increase in other forms of dementia, such as alcoholic, post-head trauma, post-anoxia and those undiagnosed and related to specific neurological diseases, such as Huntington's Chorea and Parkinson's disease, has significantly increased multi-infarct dementias among patient populations in the nation's 25,000 nursing homes, and its 7,015 registered and 214 unregistered hospitals.

In the care of the aged, and particularly the care of incontinent aged and the aged who have suffered a stroke or other injury that deprives them of the use of some or all of their limbs, problems arise for both the patient and the attendant. As a matter of fact, such problems also exist for many patients who are not aged. This invention provides means for overcoming the problems encountered.

While some improvements have been made in both equipment for patients who are able to walk and more or less take care of themselves, little or no emphasis has been made or devoted to improving bath equipment for bed-ridden patients, particularly the incontinent, in order to make such bath equipment more care efficient.

Incontinent patients, including those who have little or no use of their limbs, experience feelings of a sense of neglect, indignity, and humility because of their conditions of urinary and fecal incontinence. This condition exists in hospitals, nursing homes, and in private homes. The conditions are made worse by the reactions of employee attendants and relatives, perhaps unintentional, to the conditions which exist because of poorly designed bath equipment. The present invention provides means for overcoming these conditions.

Although there is a tremendous impact upon the lives of patients, attendants, and relatives by the cited conditions, attempts to deal with the problem of incontinence, primarily fecal incontinence, have been feeble and the focus has been misdirected. The result has been that the relationship between patients and their relatives is psychologically depressing, esthetically repulsive, and socially demoralizing.

The problem of total dependence of bed-ridden, or bed to wheelchair patients associated with incontinence, is a severe burden and almost impossible to deal with where a single attendant is involved. Patient neglect and abuse normally follow.

Federal and state regulations in most cases mandate that a minimum of two hours of care be provided to patients in skilled nursing facilities. In many cases the problem of incontinence makes such standards unattainable.

In the prior art, the cleaning of a soiled patient still requires the use of a basin of water drawn at a sink located within or outside of a a patient's room, or the use of sink into which the hands are put repeatedly during the process of cleaning the patient's body. Thus, the water or other solution being used is immediately soiled and so soiled and contaminated water is reused. The present invention provides a means for minimizing the handling of human waste by bringing the necessary supply of water to the patient.

The present invention overcomes these problems. The patient is relieved of the depressing, self-imposed isolation, and other indignities that incontinent patients feel. The attendants, professional or semi-professional, and relatives, providing nursing care have an improved means of providing the care. The portable bath facility enables even the non-skilled in the art of caring for the sick, particularly the incontinent, to provide proper care with a minimum of difficulty. The cleaning is further facilitated when performed in conjunction with the aforementioned patient transport and care vehicle.

The portable gravity bath can be carried easily, can be placed upon a stand or other means for use, and can be hung from supports or from a wall. The capacity can be varied with the size of the unit, although normally a one gallon size is sufficient.

Warm water is normally used as the liquid, however, it is to be understood that a solution containing a soap or a disinfectant or other substance is within the scope and intent of this invention.

It is, therefore, an object of this invention to provide a portable bath device that provides a flow of liquid by gravity.

It is another object of this invention to provide a portable bath device that may be carried to the point of use.

It is also an object of this invention to provide a portable bath device that may be set upon a stand-like facility for use.

It is yet another object of this invention to provide a portable bath device that may be supported from hangers.

It is still another object of this invention to provide a portable bath device that eliminates the use of soiled liquid in cleaning a patient.

It is yet still another object of this invention to provide a portable bath device that facilitates the cleaning of incontinent patients in a manner that both skilled and unskilled attendants may use.

It is also another object of this invention to provide a portable bath device that facilitates the cleaning of patients who lack the use of their limbs.

It is still another object of this invention to provide a portable bath device which is needed to obviate the necessity for institutionalization of dependent and incontinent patients in nursing homes and hospitals due to incontinence because of a lack of appropriate equipment.

Further objects and advantages of the invention will become more apparent in light of the following description of the preferred embodiments.

BRIEF DESCRIPTION OF THE DRAWINGS

FIG. 1 is a side view of a portable gravity bath;

FIG. 2 is an end view of FIG. 1;

FIG. 3 is a cross sectional view of a portable utility type table with a portable gravity bath thereon;

FIG. 4 is a side view of a portable gravity bath supported by adjustable stands.

DESCRIPTION OF THE PREFERRED EMBODIMENTS

Referring now to the drawings and particularly to FIGS. 1, 2, 3, and 4, a portable gravity bath is shown at 10. FIG. 1 shows a side view of a portable bath 10 and FIG. 2 shows an end view thereof. In these views the portable gravity bath 10 is shown as being rectangular on each side and on the ends, however, it is to be understood that it is within the scope and intent of this invention to configure the portable gravity bath 10 in other geometrical shapes instead of a rectangular prism.

The advantage of using the rectangular prism shape is the convenience in handling and in locating it on a surface support, such as shown in FIG. 3 as a utility table or cart 26.

The portable gravity bath 10 consists of a tank-like means 12, enclosed on all sides and ends and on the top 14 and the bottom 16. The tank-like means 12 being hollow, may be constructed to any capacity. However, it is the intent that the capacity for most normal needs and uses as a portable gravity bath 10 would be sufficient to hold approximately one gallon of liquid. Such a capacity would be light enough to handle conveniently and manually and is the approximate capacity required to clean a soiled incontinent patient as described hereinafter. It is to be understood that a plurality of sizes, and the resultant plurality of capacities, of the tank-like means 12 is within the scope and intent of this invention.

The tank-like means 12 may be fabricated of a plastics, waterproof canvas, rubber, or other similar material or even a very light metal if desired. The flexibility of a tank-like means 12 fabricated from a plastics, waterproof canvas, or other similar material is desirable. The use of these latter materials is obviously advantageous in case the tank-like means 12 is dropped accidentally.

The tank-like means 12 has combination fill and vent ports 20 at the upper most side or top 14. The fill/vent ports 20 are shown at the corners of the tank-like means 12, but it is to be understood that the fill/vent ports 20 may be located at any position on or along the top 14 surface, and such variation in the location is within the scope and intent of the invention.

Two vent and/or fill ports 20 are shown affixed to the tank-like means 12, one at each end, to facilitate filling the portable gravity bath 10 with a liquid. While one of the fill/vent ports 20 is used as the fill port, the other is used as a vent in order to permit the water to flow freely into the tank-like means 12 without any back pressure build-up and a consequent sputtering or spilling of liquid at the fill port 20.

Each of the fill/vent ports 20 has a removably affixed cap 22 thereon. The cap 22 prevents spillage of liquid while the portable gravity bath 10 is being handled or transported. These closure caps 22 may be press fit, plug type, or screw or threaded type.

At one end of the tank-like means 12 at the bottom 16, a valve-type drain or outlet means 24 is provided and affixed to the tank-like means 12. Only one drain or outlet means 24 is shown, however, it is to be understood that more than one may be used and such a variation is within the scope and intent of this invention.

The drain valve 24 is shown on a corner of the tank-like means 12 to facilitate placing the portable gravity bath 10 for use. When the drain valve 24 is on a corner as illustrated, the drain valve 24 will extend beyond the edge of a utility table 26, if being used in that manner. The valve facility of the drain valve 24 permits control of the flow of liquid from the tank-like means 12. It is to be understood that the drain valve 24 may be located at any point on the tank-like means 12.

The outboard end (not numbered) of the drain valve 24 is configured so that a small flexible rubber-like hose (not shown) can be removably slipped on to the outboard end of the drain valve 24. Such a hose is used to direct a stream of liquid from the tank-like means 12 to soiled portions of a patient in order to wash off urine or fecal matter from the body of a patient and then clean the patient. A bath blanket is used under the patient to absorb the liquid and catch urine and fecal matter as it is washed off of the patient. A rubber, or rubberized cover, may be used under the bath blanket to protect the mattress or spring or other facility during the cleaning of a patient.

A pair of hanger loops 18 are affixed to the top 14 of the tank-like means 12. These hanger loops 18 are set and located to one side of the top 14. When the tank-like means 12 is suspended from supports 38, as shown in FIG. 4, the hanger loops 18, being located to one side, tilt the tank-like means 12 slightly so that the liquid will flow to the drain valve 24 side of the tank-like means 12 and facilitate emptying the tank-like means 12.

The portable supports 38 may be rigid or telescoping (as shown). The telescoping supports 38 permit adjusting the height of the portable gravity bag 10, in relation to the position of the patient, so that the liquid will flow freely and with enough force to wash off urine and fecal matter.

The telescoping supports 38 are stanchion-like and each has a base 36 to interface with the floor and each has a hook-like member 40 on which the hanger loops 18 are removably placed. It is to be understood that the hanger loops 18 may be located in any position on the top 14 of the tank-like means 12, with the location on one side of the top 14 being preferred as described hereinbefore.

The utility table or cart 26 is shown with a top or shelf 28 on which the portable gravity bath 10 is placed. The utility table or cart 26 is of a height so that liquid will flow by gravity from the aforementioned hose to a patient on a bed or mobile stretcher being cleaned. The utility table or cart 26 has other shelves 30 on which towels and other supplies may be carried for cleaning a patient, including drying the patient after cleaning with the stream of water as aforementioned.

The utility table or cart 26 has a plurality of wheels 32 to make it easily portable with the portable gravity bath 10 thereon. An enclosing rail 29 may be added and affixed to the utility table or cart 10 to maintain the position of the portable gravity bath thereon. A hand bar 34 is affixed to the utility table or cart 26 to facilitate pushing and steering the utility table or cart 26.

Thus, the portable gravity bath 10 of this invention permits bringing or delivering a convenient bath unit to the patient, particularly incontinent patients and the aged and infirm. Using the aforementioned hose affixed to the drain valve 24, a stream of liquid can be directed at the soiled parts of an incontinent patient to make cleaning easy.

As can be readily understood from the foregoing description of the invention, the present structure can be configured in different modes to provide the ability to furnish a stream of water, flowing by gravity, for a bath of an incontinent or infirm patient.

Although the claims of this invention are indicated in this application, it should be construed that modifications and variations not specified in this invention, to which the invention may be susceptible, are intended to be included in the scope of this invention.

What is claimed is:

1. A portable liquid container, comprising:

an enclosed structure, said enclosed structure being compact and portable by carrying manually, said enclosed structure being hollow, said enclosed structure being for the purpose of holding and containing a liquid for subsequent disposal, said hollow enclosed structure being fabricated from lightweight flexible water proof material, said flexible waterproof material having insulating qualities, said enclosed structure having a first side and a second side, a first end and a second end, a bottom, and a top, said first and second sides, first and second ends, bottom, and top each being flat and spaced apart and suitably affixed to each other to form said enclosed structure into a rectangular prism-like structural configuration, said hollow enclosed structure having first, second, and third apertures therein, each of said apertures communicating the hollow inside of said enclosed structure with the exterior thereof, said first aperture being located at a first uppermost corner of said enclosed structure at a juncture of said top, said first side, and said first end, said second aperture being located at a second uppermost corner of said enclosed structure at a juncture of said top, said first side, and said second end, said third aperture being located at a lowermost corner of said enclosed structure at a juncture of said bottom, said first side and said second end, said lowermost corner being the corner directly below said second uppermost corner;

a first hollow tubular member, said first hollow tubular member having a first end and a second end, said first end of said first hollow tubular member being suitably affixed to said first aperture in said hollow enclosed structure, said first hollow tubular member thereby communicating said hollow inside of said hollow enclosed structure through said first aperture and through said first hollow tubular member with the exterior thereof, said first hollow tubular member having a removably affixed cap on the distal second end thereof;

a second hollow tubular member, said second hollow tubular member having a first end and a second end, said first end of said second hollow tubular member being suitably affixed to said second aperture in said hollow enclosed structure, said second hollow tubular member thereby communicating said hollow inside of said hollow enclosed structure through said second aperture and through said second hollow tubular member with the exterior thereof, said second hollow tubular member having a removably affixed cap on the distal second end thereof;

a drain valve means, said drain valve means having a first end and a second end, said first end of said drain valve means being suitably affixed to said third aperture in said hollow enclosed structure, said drain valve means thereby communicating said hollow inside of said hollow enclosed structure through said third aperture and through said drain valve means with the exterior thereof, said second end of said drain valve means being suitably configured for the attachment of a hose means; and a plurality of hanger members, said plurality of hanger members being suitably affixed to the exterior of said hollow enclosed structure, said plurality of hanger members each being configured in a loop-like form, one of said plurality of hanger members being located on said top of said hollow enclosed structure at the juncture of said top with said second side at said first end, another of said plurality of hanger members being located on said top of said hollow enclosed structure at the juncture of said top with said second side at said second end, said plurality of hanger members being suitable as hand grips to manually carry said hollow enclosed structure and for hanging said hollow enclosed structure from mechanical supports, said hollow enclosed structure thereby being tilted toward side of said drain valve means when suspended from said plurality of hanger members, said first and second hollow tube members serving as fill ports and as vents when at least one of said removably affixed caps is removed from said hollow tubular members, said tilting of said hollow enclosed structure toward side of said drain valve means assuring complete drainage through said drain means when said drain valve means is used as a discharge means.

2. A portable liquid container as recited in claim 1 and additionally, a support means, said support means being for the purpose of supporting said portable liquid container, said support means being of a sufficient height to permit said liquid to flow from said hollow enclosed structure through said drain valve means by means of gravity.

3. A portable liquid container as recited in claim 2 and additionally, a hollow hose-like tube means, said hollow hose-like tube means being removably affixed to said second end of said drain valve means, said hollow hose-like tube means communicating said hollow inside through said third aperture and said drain valve means to said exterior thereof, said hollow hose-like tube means being for the purpose of directing the flow of a said liquid being discharged by gravity from said grain valve means.

4. A portable liquid container as recited in claim 2, wherein said support means is a utility type cart, said portable liquid container being removably placed upon said utility type cart said utility type cart having restraining means around said liquid container.

5. A portable liquid container as recited in claim 2, wherein said support means is at least one stanchion-like pole, said stanchion-like pole being a telescoping structure, said telescoping structure providing a plurality of adjustable heights, said stanchion like pole having a base means affixed thereto for stability, said stanchion-like pole having a hook means affixed thereto near the top thereof, said hanger member being removably affixed to said hook means.

6. A portable liquid container as recited in claim 1, wherein said flexible waterproof material is rubber-like.

7. A portable liquid container as recited in claim 1, wherein said flexible waterproof material is a plastics.

8. A portable liquid container as recited in claim 1, wherein said portable liquid container is a bath means for patients.

* * * * *